US007837386B2

(12) United States Patent
Levati et al.

(10) Patent No.: US 7,837,386 B2
(45) Date of Patent: Nov. 23, 2010

(54) ASEPTIC SPOUTLESS POUCH AND METHOD FOR PACKAGING FOOD PRODUCTS

(75) Inventors: Manuele Levati, Parma PR (IT); Gianluca Oddi, Parma PR (IT); Gianluca Parisini, Parma PR (IT); Giovanni Rossi, Parma PR (IT)

(73) Assignees: MFC Technologies Italia S.p.A., Parma PR (IT); John Bean Technologies S.p.A., Parma PR (IT)

( * ) Notice: Subject to any disclaimer, the term of this patent is extended or adjusted under 35 U.S.C. 154(b) by 60 days.

(21) Appl. No.: 11/970,258

(22) Filed: Jan. 7, 2008

(65) Prior Publication Data

US 2009/0173047 A1 Jul. 9, 2009

(51) Int. Cl.
*B65D 33/10* (2006.01)
*B65B 3/04* (2006.01)

(52) U.S. Cl. ..... 383/7; 383/38; 53/467; 53/469

(58) Field of Classification Search ..... 53/467, 53/468, 469, 284.7, 275, 268; 383/35, 38, 383/39, 40, 7, 66
See application file for complete search history.

(56) References Cited

U.S. PATENT DOCUMENTS

| | | | | | |
|---|---|---|---|---|---|
| 2,990,101 | A * | 6/1961 | Mead et al. | 383/35 |
| 3,186,625 | A * | 6/1965 | Mead | 383/37 |
| 3,245,200 | A * | 4/1966 | Shaw | 53/512 |
| 3,340,671 | A * | 9/1967 | Loo | 53/426 |
| 4,216,639 | A * | 8/1980 | Gautier | 53/413 |
| 4,709,534 | A * | 12/1987 | Sengewald | 53/452 |
| 4,717,046 | A * | 1/1988 | Brogli | 222/107 |
| 4,808,179 | A * | 2/1989 | Lindstam | 604/408 |
| 4,981,374 | A * | 1/1991 | Rutter et al. | 383/37 |
| 5,669,208 | A * | 9/1997 | Tabaroni et al. | 53/453 |
| 5,984,912 | A * | 11/1999 | Niedospial et al. | 604/408 |
| 6,398,771 | B1 * | 6/2002 | Gustafsson et al. | 604/410 |
| 6,533,711 | B1 * | 3/2003 | Anderson et al. | 493/213 |
| 7,150,136 | B2 * | 12/2006 | Perkins et al. | 53/403 |
| 7,223,462 | B2 * | 5/2007 | Perkins et al. | 428/166 |
| D548,613 | S * | 8/2007 | Miller et al. | D9/710 |
| D584,168 | S * | 1/2009 | Murray | D9/710 |
| 2007/0211967 | A1 * | 9/2007 | Murray | 383/38 |

FOREIGN PATENT DOCUMENTS

| | | | |
|---|---|---|---|
| EP | 0567912 | A1 | 11/1993 |
| FR | 1128387 | A | 1/1957 |
| JP | 2002114231 | A | 4/2002 |
| JP | 2004262537 | A | 9/2004 |

* cited by examiner

*Primary Examiner*—Paul R Durand
(74) *Attorney, Agent, or Firm*—Lucas & Mercanti, LLP

(57) ABSTRACT

The present invention relates to an aseptic pouch (1) for packaging food products, comprising two walls which are bonded together so as to define an internal space (2) which is sterilized and hermetically closed. The pouch (1) further comprises at least one sealing (7; 12) which joins together said walls, extending between opposite sides (5, 6) of the pouch, (1) and defines a neck portion (8) of said internal space (2) and two border portions (9) external to said internal space. Said neck portion (8) is suitable for providing, after opening of the pouch (1), an access to said internal space (2) and said border portions (9) are suitable for providing grips for handling said pouch. The invention also relates to a method for packaging a food product in said aseptic pouch (1).

12 Claims, 3 Drawing Sheets

ASEPTIC SPOUTLESS POUCH AND METHOD FOR PACKAGING FOOD PRODUCTS

BACKGROUND OF THE INVENTION

The present invention relates to a spoutless aseptic pouch and to a method for packaging food products.

Pouches which can be used for packaging food products having high degradability are known, which are presealed and their internal space, which is thus completely closed, is sterilized.

Said pouches are generally sold in webs comprising a plurality of pouches connected one to the other. The webs can be fed as such to some known food product packaging apparatuses, which are provided with a device for cutting the web in single pouches which can be closed or already opened. In the case that the pouch is closed, the apparatuses which perform the packaging of food products are also provided with a device for opening the pouches which cuts each pouch close to an edge thereof removing it entirely. Subsequently, the pouch is filled with the food product and resealed.

The removed edge forms a waste which is taken away from the rest of the pouch and discharged by the packaging apparatus. Thus, the apparatus needs to be accordingly designed for carrying out this step. It is therefore clear that the creation of a waste resulting from the step of opening the pouches is a drawback, which complicates the packaging process since it implies the need of a further step to be carried out. Further, the formation of the waste requires the presence, in the apparatus, of an additional opening for its elimination, thus increasing the risk of pollution from external contaminants. On the other hand, opening the pouches only when it is inside the aseptic portion of the packaging apparatus is a necessary condition for carrying out the packaging of food products having high degradability.

Pouches have already been disclosed which comprise reinforcing weldings or inserts, having the most dissimilar functions, for instance the function of increasing the strength of the pouch in the area of the handle.

U.S. Pat. Nos. 2,951,628 and 3,924,383 disclose pouches provided with an L-shaped reinforcing welding which defines a portion of the pouch where a handle is provided, and at the same time defines an emptying channel which allows easily pouring of the pouch content.

Also U.S. Pat. No. 5,378,065 discloses a pouch provided with a channel for emptying the food product made by means of an additional welding.

However, the pouches disclosed in the above mentioned patents are not presealed, but are superiorly open, and are seated only after the filling thereof. Therefore, said pouches are not suitable for carrying out an aseptic packaging of food products having high degradability.

SUMMARY OF THE INVENTION

An object of the present invention is therefore to provide an aseptic pouch and a method for packaging a food product, which are free from the above mentioned drawbacks. Said object is obtained by means of an aseptic pouch whose main features are specified in the first claim and other features are specified in the following claims, and a web whose features are specified in claim 9. The features of the method for packaging a food product are specified in claims 10 and 11.

The main advantage of the presealed and internally presterilized pouch according to the present invention consists in that, thanks to a particular sealing of which it is provided, it can be opened, filled and sealed inside an apparatus of known type, without creating wastes.

Another advantage of the aseptic pouch according to the present invention consists in that it does not require a high precision in carrying out the steps of opening and closing the pouch.

In addition, independently of the size of the pouches, opening and closing devices having fixed dimension can be used, so as to avoid expensive adjustments of the apparatus which were necessary up to now when changing from large to small pouches or vice versa.

A further advantage of the aseptic pouch according to the present invention consists in that the opening step thereof by means of a packaging apparatus involves also the creation of a handle in a reinforced portion of the pouch.

Further advantages and features of the aseptic pouch according to the present invention will be clear for those which are skilled in the art from the following detailed and non limiting description of two embodiments thereof which make reference to the accompanying drawings.

DETAILED DESCRIPTION OF THE INVENTION

Figure 1:
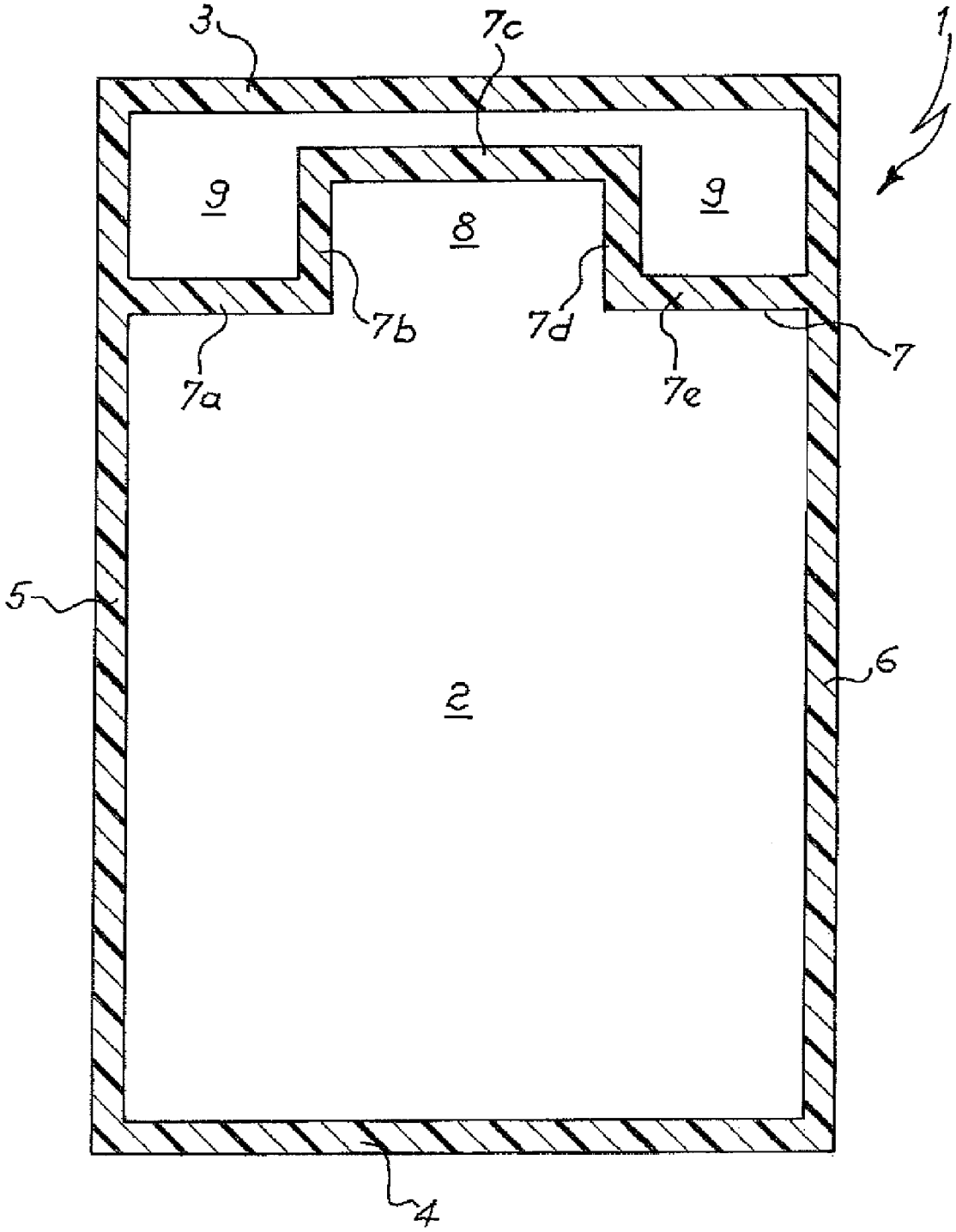
FIG. 1 shows a front view of an aseptic pouch according to a first embodiment of the invention.

With reference to FIG. 1, there is shown that the aseptic pouch 1 according to the present invention comprises two walls bonded together so as to form an internal space 2 of the pouch which is sterilized and hermetically closed.

The two walls are made preferably with a sealable plastic material, suitable for packaging food products. For example, polycoupled materials can be used. Said materials are known in the field and have also the property of gas-tightness, so that pouch 1, once it has been closed and internally sterilized with known methods, for instance by treatment with gamma rays, maintains indefinitely its aseptic features.

In the embodiment shown in the figures, pouch 1 has a substantially quadrangular shape, which is preferred since it is easy to manufacture and can be advantageously provided to the final users in the shape of a web comprising a plurality of pouches connected one to the other. However, also pouches having other shapes than the quadrangular one could be connected in series so as to form a web, for example pouches having slightly curved lateral sides which converge towards the center of the lower edge.

The walls of pouch 1 can be formed either from two separate sheet elements, sealed at the upper edge 3, lower edge 4 and lateral edges 5 and 6, as shown in the figure, or from a single tubular element, flattened and transversally sealed so as to form an upper and a lower edge of the pouch, according to a process known in the field.

In the present description and in the claims, by sealing is meant a hermetical junction of the pouch walls, which can be made by means of thermo welding or ultrasound welding, or with other methods such as gluing of the two walls with a glue which is gas-tight and suitable for the contact with food.

According to the invention, pouch 1 is also provided with a sealing 7 which joins together said walls and extends between opposite sides of the pouch, and in particular, in the embodiment of the invention which is shown in the figures, between lateral sides 5 and 6, Sealing 7 is suitable for defining, in said internal space 2, a neck portion 8, separating it from two border portions 9, external to said internal space, which are adjoining said neck portion 8 at the two sides of the pouch.

Figure 2:
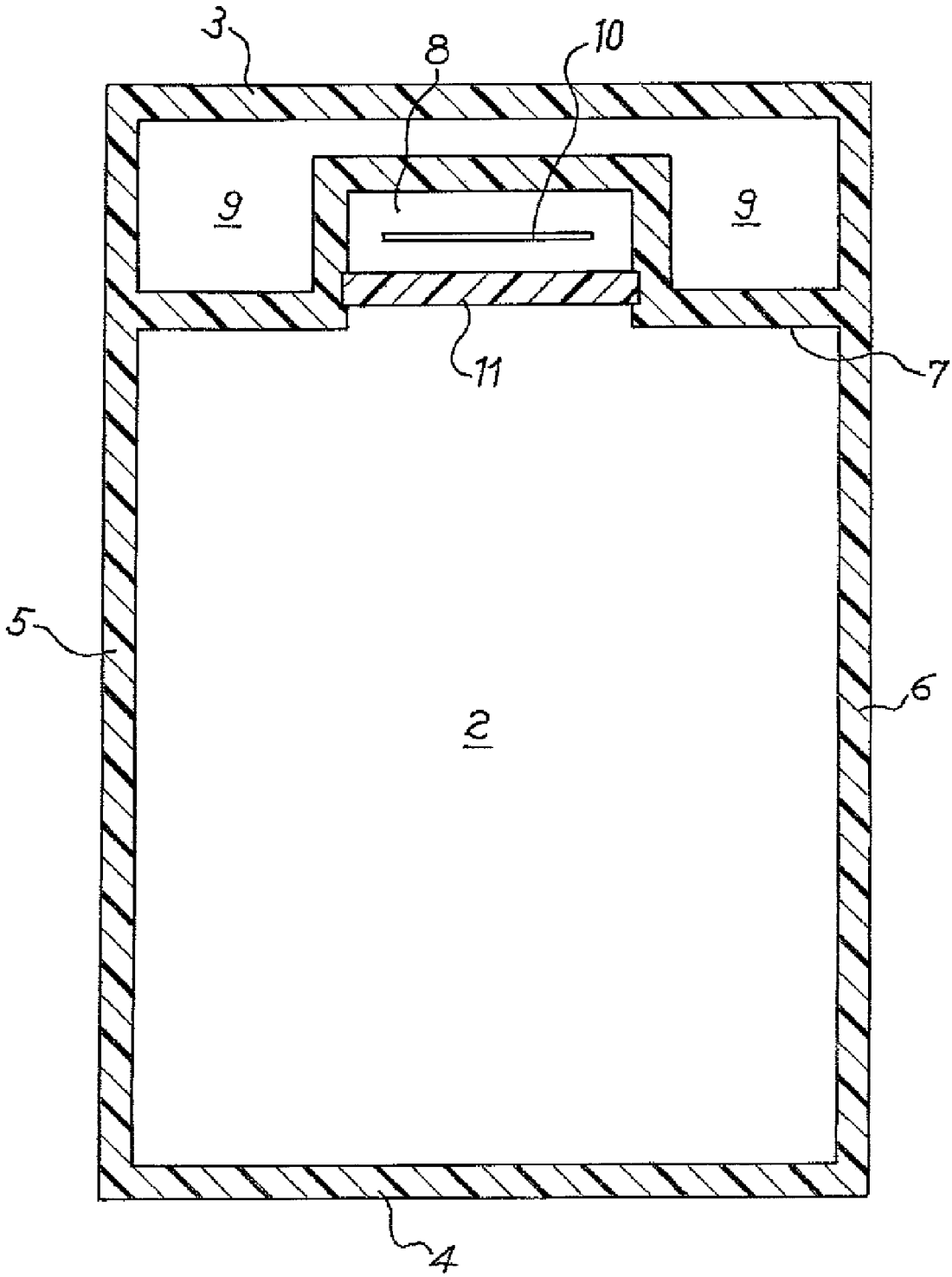
FIG. 2 Shows a front view of the pouch of FIG. 1, already filled in with a food product and closed.

Neck portion 8 forms a thin and restricted portion of the internal space 2 and, as it will be described more in detail with reference to FIG. 2, is suitable for providing an access to said internal space 2 after opening the pouch by means of a suitable device of the packaging apparatus.

On the contrary the two border portions 9, between which neck portion 8 is arranged, are not included in the internal space 2 and form ideal grip areas for handling the pouch by means of a suitable device of the packaging apparatus.

In a preferred embodiment of the invention, said sealing 7 defines a broken line comprising at least five segments which separate a neck portion 8 from two border portions 9 at the sides thereof. In particular, two external segments 7*a* ad 7*e* and a central segment 7*c* are arranged transversally with respect to the opposite edges of the pouch between which extends the sealing 7, for instance perpendicularly. Two other segments 7*b* and 7*d* are obviously necessary to link the free ends of the first mentioned segments. Sealing 7 can comprise a higher number of segments, for example six or seven, which are anyway preferably arranged substantially in a symmetrical way with respect to the center of said broken line.

Figure 1A:
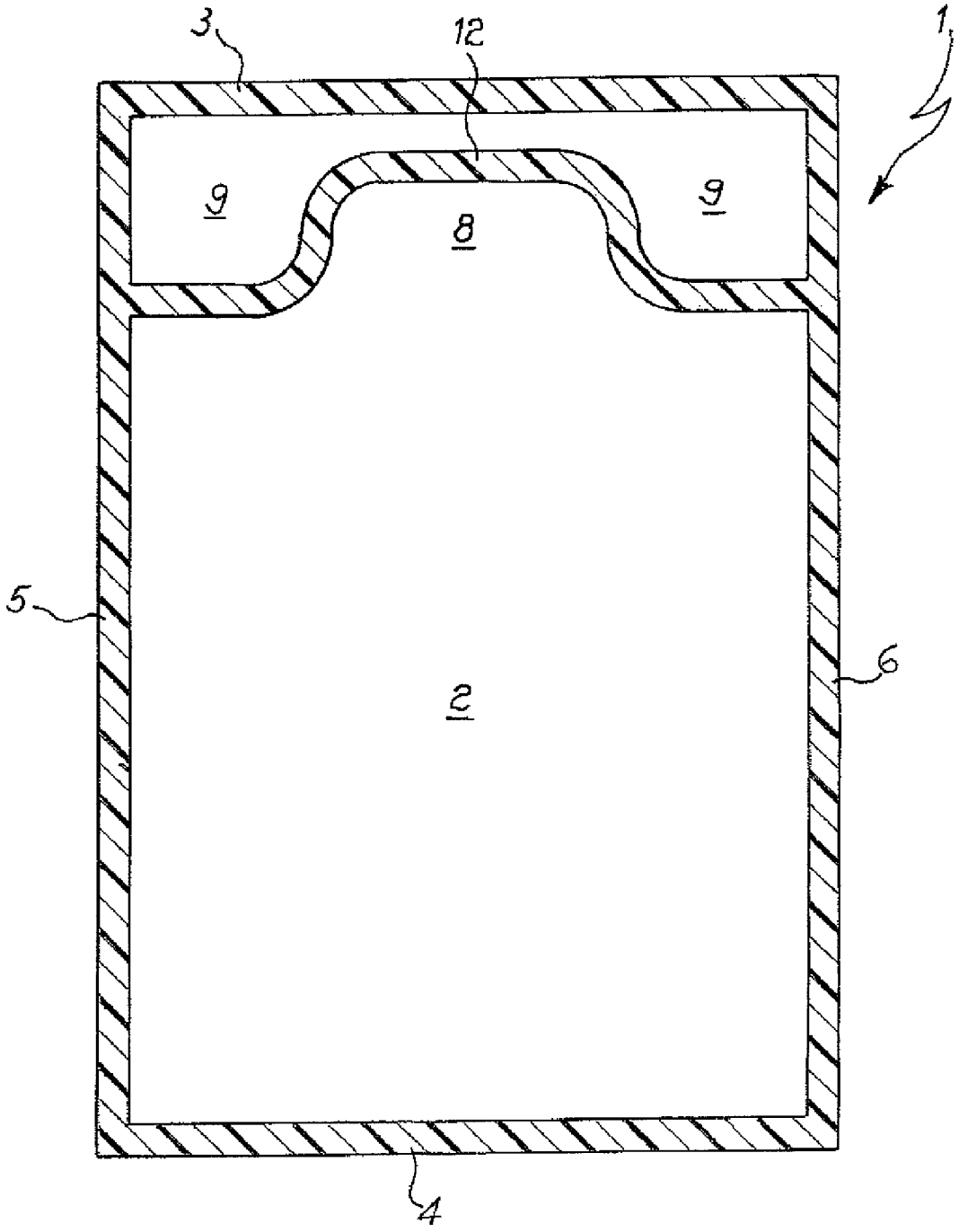
FIG. 1*a* shows a front view of an aseptic pouch according to a second embodiment of the invention.

According to an alternative embodiment of the invention, shown in FIG. 1*a*, the line defined by a sealing 12 is curved, and separates also in this case a neck portion 8 of the internal space 2 from two border portions 9 external to said internal space.

In the embodiments of the invention shown in FIGS. 1 and 1*a*, the border portions 9 are internally free from scalings, however further scalings between the walls of the pouch could be provided in said border portions or even in the internal space of the pouch, for example reinforcing sealings or scalings having other purposes.

Now, with reference to FIG. 2, there is shown the pouch of FIG. 1 after that it has been submitted to a packaging method according to the present invention in a packaging machine of a known type.

In said apparatus, the pouch can be seized and handled through its border portions 9. Pouch 1 is then cut in aseptic environment within neck portion 8, so as to form an opening 10 for the access to the internal space 2.

The cutting of the pouch does not involve the creation of any waste since no part of the pouch is removed.

Besides, since the size of the cutting device is proportioned to that of the neck portion 8 and not to that of the whole pouch, the filling of pouches having different sizes can be made with the same apparatus, without need to modify or adapt said apparatus by changing from large to small pouches or vice versa. As a matter of fact it is sufficient to provide pouches according to the present invention of various sizes, but having a neck portion of standard size.

Inside said opening 10 is then inserted a filling nozzle of the packaging apparatus which injects a desired quantity of a food products inside internal space 2. Subsequently, the filling nozzle is taken out of opening 10 and the pouch is closed by means of a sealing 11, preferably a thermo welding or an ultrasound welding, which is made between said opening 10 and the base of said neck portion 9. In the present description and in the claims, base of the neck portion 9 means the area where said neck portion 9 opens into the internal space 2. Also the sealing device of the packaging apparatus is proportioned to the size of the neck portion 8 and not to that of the pouch 1, with the same advantage above indicated for the cutting device.

Opening 10 forms at this point a useful handle for carrying pouch 1, which is also reinforced thanks to sealing 7.

Possible variations and/or additions can be made by those which are skilled in the art to the invention hereby described and illustrated still remaining within the scope of the following claims.

The invention claimed is:

1. An aseptic pouch for food packaging products, comprising:

at least two walls which are bonded together so as to define and bound an internal space which is hermetically sealed, each of said walls having a first side, a second side, a third side and a fourth side, said first side opposing said third side and said second side opposing said fourth side;

at least one sealing joining said walls extending between opposite sides of said pouch having a plurality of segments;

a neck portion, defined by said sealing and located near said first side of said pouch, providing, after opening said sealing of said pouch, access to said internal space; and two border portions of substantially equivalent length external to said internal space proximate said neck portion, providing grip areas for handling said pouch, wherein said neck portion is substantially centered between said second side and said fourth side of said pouch, and wherein said segments forming the neck portion include:

a first segment, having a first end and a second end, disposed between said second side and said fourth side of said walls and operatively extending from said second side of said walls at said first end of said first segment, a second segment, having a first end and a second end, disposed between said second side and said fourth side of said walls and operatively extending from said fourth side of said wall at said first end of said second segment, a third segment, having a first end and a second end, said first end of said third segment operatively extending from said second end of said first segment, forming a first wall defining said neck portion, a fourth segment, having a first end and a second end, said first end of said fourth segment operatively extending from said second end of said second segment, forming a second wall defining said neck portion, and a fifth segment interposed between said third segment and said fourth segment.

2. The aseptic pouch according to claim 1, wherein said sealing is curved.

3. The aseptic pouch according to claim 1, wherein said pouch has a substantially quadrangular shape, said sealing extending between edges of said pouch which are not contiguous.

4. The aseptic pouch according to claim 1, wherein said pouch has one or more further sealings which join together said walls of said pouch extending within said border portions.

5. The aseptic pouch according to claim 1, wherein said walls are made of a weldable polycoupled material.

6. The aseptic pouch according to claim 1, wherein the first side, the second side, the third side and the fourth side of the walls are each linear.

7. A method for packaging a food product in an aseptic pouch according to claim 1, wherein the method comprises the steps of:

cutting within said neck portion of said pouch, forming an opening for access to said internal space;

filling said pouch through said opening; and sealing said pouch.

8. The method according to claim 7, wherein said sealing is carried out between said opening and said base of said neck portion.

9. A web, comprising:

a plurality of pouches according to claim 1, connected together.

10. An aseptic pouch for food packaging products, comprising:

sheets having an upper edge, a lower edge and a first side edge and a second side edge extending between the upper edge and the lower edge, bonded together forming a pouch defining an internal space which is hermetically sealed; and a seal predominately spaced from the upper edge, joining the sheets and extending between the first side edge and the second side edge of the pouch, the seal having a plurality of segments forming a neck portion which is substantially centered between the first side edge and the second side edge of the pouch, the seal also having border portions of substantially equivalent length providing grip areas for handling the pouch, the grip areas being formed proximate the neck portion, between the upper edge and said seal, the segments forming the neck portion include:

a first segment, having a first end and a second end, disposed between the first side edge and the second side edge and operatively extending from the first side edge at the first end, a second segment, having a first end and a second end, disposed between the first side edge and the second side edge and operatively extending from the second side edge at the first end, a third segment, having a first end and a second end, the first end of the third segment operatively extending from the second end of the first segment, forming a first wall defining the neck portion, a forth segment, having a first end and a second end, the first end of the fourth segment operatively extending from the second end of the second segment, forming a second wall defining the neck portion, and a fifth segment interposed between the third segment and the fourth segment providing, after opening the pouch, access to the internal space.

11. The aseptic pouch according to claim 10, wherein the third segment extends substantially perpendicular from the second end of the first segment and the fourth segment extends substantially perpendicular from the second end of the second segment.

12. The aseptic pouch according to claim 10, wherein the upper edge, the lower edge, the first side edge and the second side edge are each linear.

* * * * *